United States Patent [19]

Geering et al.

[11] Patent Number: 4,628,884

[45] Date of Patent: Dec. 16, 1986

[54] METHOD FOR LAMBDA CONTROL IN AN INTERNAL COMBUSTION ENGINE

[75] Inventors: Hans P. Geering, Winterthur, Switzerland; Gerhard Heess, Tamm; Helmut Schwarz, Vaihingen, both of Fed. Rep. of Germany

[73] Assignee: Robert Bosch GmbH, Stuttgart, Fed. Rep. of Germany

[21] Appl. No.: 813,022

[22] Filed: Dec. 24, 1985

Related U.S. Application Data

[63] Continuation-in-part of Ser. No. 657,238, Oct. 3, 1984, abandoned.

[30] Foreign Application Priority Data

Oct. 11, 1983 [DE] Fed. Rep. of Germany ..... 3336894

[51] Int. Cl.[4] ..... F02D 41/32

[52] U.S. Cl. ..... 123/489

[58] Field of Search ..... 123/440, 489, 419, 436

[56] References Cited

U.S. PATENT DOCUMENTS

| | | | |
|---|---|---|---|
| 4,026,251 | 5/1977 | Schweitzer et al. | 123/419 X |
| 4,195,604 | 4/1980 | Toplin | 123/489 X |
| 4,287,865 | 9/1981 | Seitz | 123/489 |
| 4,377,143 | 3/1983 | Hamburg | 123/440 |
| 4,378,773 | 4/1983 | Ohgami | 123/489 X |
| 4,402,291 | 9/1983 | Aono | 123/489 X |
| 4,402,293 | 9/1983 | Ohgami | 123/489 X |
| 4,428,342 | 1/1984 | Suzuki et al. | 123/436 X |
| 4,448,162 | 5/1984 | Ninomiya et al. | 123/419 |
| 4,448,171 | 5/1984 | Ninomiya et al. | 123/419 |
| 4,483,300 | 11/1984 | Hosaka et al. | 123/489 |

*Primary Examiner*—Tony M. Argenbright
*Attorney, Agent, or Firm*—Walter Ottesen

[57] ABSTRACT

The invention is directed to a method for the formation of an air-fuel mixture for an internal combustion engine, including an oxygen sensor exposed to the exhaust gas and responsive to the oxygen content of the exhaust gas, a signal-processing unit processing the output signals of the oxygen sensor, and a memory store for storing a set of characteristic curves dependent on at least one operating parameter of the internal combustion engine, the characteristic values thereof ($F_\lambda$) determining the amount of fuel to be metered. In this method, a time-variable perturbation ($\Delta F_\pm$) is superposed on the characteristic values ($F_\lambda$), the oxygen sensor output signals ($U_\lambda$) are evaluated with regard to their change due to the perturbation ($\Delta F_\pm$), and the characteristic values ($F_\lambda$) are suitably corrected to achieve an optimum air-fuel ratio. In this arrangement, the modulation frequency of the characteristic values ($F_\lambda$) is to assume as high values as possible while the modulation amplitude is to be as low as possible. This method permits a substantial increase in the limit frequency of the Lambda sensor operation cycles.

22 Claims, 7 Drawing Figures

METHOD FOR LAMBDA CONTROL IN AN INTERNAL COMBUSTION ENGINE

RELATED APPLICATION

This is a continuation-in-part of the application Ser. No. 657,238 filed on Oct. 3, 1984, now abandoned, and entitled "Method for Lambda Control in an Internal Combustion Engine".

FIELD OF THE INVENTION

The invention relates to a method for forming an air-fuel mixture in an internal combustion engine. The internal combustion engine includes an oxygen sensor which is subjected to the exhaust gas and is sensitive to the oxygen content thereof. Also, the engine includes a signal processing unit which processes the output signal of the oxygen sensor and a storage unit for storing a characteristic field of characteristic field values for determining the quantities of fuel to be metered. The characteristic field is dependent upon at least one operating parameter of the internal combustion engine.

BACKGROUND OF THE INVENTION

A great many methods and apparatus for mixture formation using an oxygen sensor are already known. Frequently, oxygen sensors are utilized which change their output quantity abruptly at a ($\lambda=1$) mixture. In the closed control circuit, the oxygen sensor normally always oscillates between the two output quantities "high" and "low".

The oxygen sensor output signal conventionally serves to correct the values stored in a fixed pre-programmed set of characteristic curves, these values determining, for example, the start of injection. On the basis of the Lambda sensor signal which is to be regarded as a quasi-binary signal, the correction factor for the set of characteristics is continuously corrected by a PI-controller, for example.

Since, in this arrangement, the air transit time through the internal combustion engine and the sensor response time are not taken into consideration, a limit cycle will occur for the correction factor of the Lambda regulator and thus, of course, also for the torque of the internal combustion engine. In particular, at low engine speeds and sufficiently high load, the operator of the vehicle equipped with the internal combustion engine will become aware of this torque limit cycle which manifests itself unpleasantly in the form of an uneven running condition. In addition, with the falling frequency, exhaust emissions will rise.

SUMMARY OF THE INVENTION

It is an object of the invention to improve upon known Lambda control methods in such a manner as to ensure smooth running of the internal combustion engine during any of its operating conditions occurring in practice, in combination with an exhaust emission, the composition of which is optimum with regard to the toxic constituents.

BRIEF DESCRIPTION OF THE DRAWING

Embodiments of the invention will now be described in more detail in the following with reference to the drawing, wherein.

DESCRIPTION OF THE PREFERRED EMBODIMENTS OF THE INVENTION

While the following embodiment will be described in connection with an intermittently driven fuel injection equipment (sequential or parallel injection), the Lambda control per se is independent of the type of mixture formation thus permitting the invention to be also used in combination with carburetor or continuous injection systems, for example.

Figure 1:
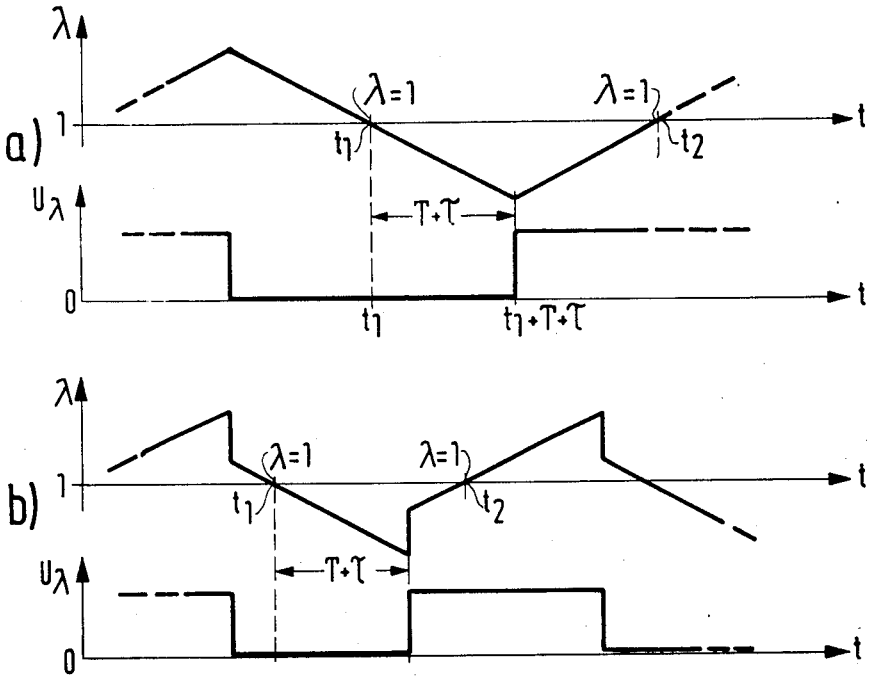
FIGS. 1(*a*) and 1(*b*) are a diagram showing characteristic Lambda sensor output signals in relation to the Lambda value of the air-fuel mixture in known control methods to explain the basic problem.

The diagrams of FIG. 1 serve to explain the problems occurring in connection with Lambda control. In FIG. 1(*a*), the Lambda value of the air-fuel mixture supplied to the internal combustion engine and the output signal of an oxygen sensor are plotted against time t, with the Lambda control incorporating an integral-action controller (I-controller) in a known manner. The Lambda value of the air-fuel mixture oscillates periodically around Lambda=1 with an amplitude that is dependent on the integration time constant of the integral-action controller and on the delay time. If the oxygen sensor operated without delay and if the mixture reached the sensor infinitely fast, its output signal $U_\lambda$ would have to change abruptly at times $t_1$ and $t_2$ at which the air-fuel mixture passes through the value $\lambda=1$. In actual fact, however, the abrupt change does not occur until after a delay time of $T+\tau$ is composed of transit time T, that is, the time the air constituents require for passage through the internal combustion engine and oxygen sensor response time $\tau$.

In the present example, the passage through $\lambda=1$ is not sensed until a time when the mixture is already enriched again considerably. This delayed response action of the oxygen sensor results in a limit cycle with a period of $P\sim4(T+\tau)$. Since the air transit time T, which shows a strong dependence on engine speed, may assume values of up to about one second (whereas the oxygen sensor response time $\tau$ is negligible at low engine speeds), this limit cycle assumes frequency values the operator of the internal combustion engine is well able to perceive.

The sequence of signals illustrated in FIG. 1(*b*) differs from the one of FIG. 1(*a*) in that it utilizes a PI-controller in the Lambda control circuit. In this case and in the event of a switching operation of the oxygen sensor, an abrupt change in the Lambda value is caused in order to accelerate the passage through ($\lambda=1$), this being in addition to a reverse integration toward $\lambda=1$. In this arrangement, a compromise is entered into, that is, the operation period of the oxygen sensor assumes smaller values while the Lambda variation increases correspondingly around the value $\lambda=1$, depending on the steepness of the ramp. By suitably choosing the proportional portion of the PI-controller, the period duration can be reduced to the minimum value of $P=2\ (T+\tau)$.

Since this delay time is not considered in a PI-controller either, a limit cycle, though smaller than the one of FIG. 1(*a*), will occur in the determination of the fuel quantity to be injected. In particular at low engine speeds and high loads, the negative effects of this limit cycle will be noticeable by the operator of the vehicle in the form of an uneven running condition.

The foregoing description only referred to constant or only slowly varying operating conditions of the internal combustion engine.

In the event of sudden load changes, "exhaust peaks" usually occur in these control systems. As a result of the above-mentioned air transit time T and the response time $\tau$, a certain amount of time will elapse until the control circuit responds to the new settings, so that during this time, a marked increase in toxic substances will occur which cannot be reduced by the catalyst provided in the exhaust pipe, for example.

Attempts are made to master this problem by storing the values for fuel metering in a set of characteristic curves in dependence on operating parameters of the internal combustion engine, for example, in dependence on the quantity of air inducted and engine speed, and by recalling these values as required. Such an arrangement involves a controlled fuel metering system wherein the essential values are available very quickly. The difficulty, however, is that slow variations such as in temperature or pressure, or wear-induced changes to the internal combustion engine, which affect the air-fuel ratio are not taken into consideration.

This difficulty can be overcome by replacing the fixed pre-programmed set of characteristics by an equivalent which, however, permits adaptation to the changed parameters at any point of the characteristic via a Lambda control. After a new point of the characteristic is accessed because the operating parameters have changed, the old optimum value is stored away at the appropriate location. Such an arrangement which is known per se helps to prevent errors in fuel metering that may occur at abrupt load changes, that is, with the internal combustion engine not stationary. However, the behavior of the internal combustion engine under constant or very slowly changing operating conditions continues to be determined by the limit cycle of the Lambda control circuit.

The basic idea of the invention proceeds from the fact that the oxygen sensor output signal $U_\lambda$ is of a quasi-binary character ($\lambda<1\rightarrow U_\lambda=H$, $\lambda>1\rightarrow U_\lambda=1$, where H=high and L=low); consequently, it provides no information on the accurate value of Lambda, permitting merely the statement "$\lambda \gtrless 1$". In fact, the oxygen sensor with its response action at $\lambda=1$ already responds to very small $\lambda$ deviations.

In order to increase the response frequency of the oxygen sensor, provisions are therefore made to superpose a high-frequency and low-amplitude perturbation on the values read out from the adaptive set of characteristics and responsible for the fuel quantity; that is, these characteristic values are modulated. The amplitude of the perturbation should be as small as possible, yet assume such values that the Lambda sensor will respond normally.

The frequency of the modulation is to meet the following requirements which, of course, may result in different individual determinations depending on the internal combustion engine concerned. Thus, the modulation frequency should assume maximum possible values so that any torque variations of the internal combustion engine that may occur are no longer noticeable. The upper limit is determined either by the oxygen sensor response time which varies particularly strongly with the temperature of the oxygen sensor, or by the speed of the internal combustion engine. The dependence on engine speed is due to the fact that repeated modulations of the fuel quantity to be metered to a cylinder compensate each other, thus affording no advantages. In sequential injection, therefore, one perturbation per fuel metering operation represents the maximum modulation frequency for each individual cylinder. It is to be understood that these particulars serve as a rough guideline for the determination of the modulation swing and the modulation frequency and that it is up to those in the art to define the most favorable values for the particular application.

The reaction of the oxygen sensor to this perturbation of maximum possible frequency and low amplitude is measured and evaluated in accordance with the algebraic sign of the perturbation to the effect that the instantaneously accessed point of the characteristic curves is changed so as to cause the air-fuel mixture to approach the value $\lambda=1$, thereby assuming the optimum value.

The engine has a plurality of cylinders sequentially ejecting pulses of exhaust gas. Preferably, the frequency of the perturbation of small amplitude is selected so high that a changeover of the condition of the signal of the oxygen sensor from high to low and vice versa can occur after a shortest possible time interval determined by the time which passes until the next one of the sequential pulses of exhaust gas reaches the oxygen sensor.

The method of the invention will be described in more detail in the following with reference to FIG. 2.

Figure 2:
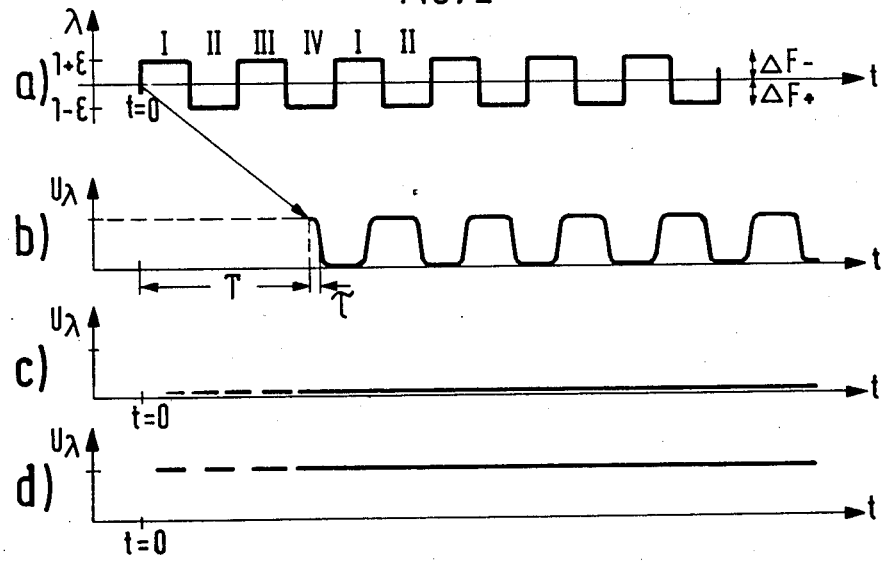
FIGS. 2(*a*)–2(*d*) are a diagram explaining the method of the invention; and, FIG. 3 is a possible arrangement for carrying out the method of the invention.

If a favorable frequency and amplitude ($\pm\epsilon$ in FIG. 2(*a*)) were chosen for the perturbation $\Delta F_\pm$ to be superposed on characteristic values $F\lambda$, the air-fuel mixture could be modulated around the value $\lambda=1$ as illustrated in FIG. 2(*a*), for example. Neglecting the oxygen sensor response time $\tau$ and setting, the maximum utilizable modulation frequency (illustrated by way of example in FIG. 2(*a*) for a four-cylinder internal combustion engine with individual injection) would mean that in the first phase cylinder 1 received a richer mixture, in the second phase cylinder 2 received a leaner mixture, and in the third phase cylinder 3 received a richer mixture, et cetera (the cylinder numbering corresponds here to the firing sequence). As will be explained further below, it is to be understood that also other modulation patterns are possible.

The sensor reaction to such a modulation of the fuel quantity to be metered to the individual cylinders of an internal combustion engine may be described with reference to three different cases. All other output signals correspond to a combination of these three possibilities which are illustrated in FIGS. 2(*b*), 2(*c*) and 2(*d*).

Regarding the case illustrated in FIG. 2(*b*), the oxygen sensor output signal accurately follows the variation of the Lambda value according to FIG. 2(*a*), delayed by air transit time T typical for the air proportions and by sensor response time $\tau$. From this it follows that the mean Lambda value $\bar{\lambda}$ of $\bar{\lambda}=1$ is correct.

In FIG. 2(*c*), the oxygen sensor shows a constantly lean mixture, irrespective of perturbation $\Delta F_\pm$ superposed on characteristic value $F_\lambda$. From this it is to be concluded that $F_\lambda$ corresponds to an insufficient quantity of fuel. By analogy, in FIG. 2(*d*) the sensor shows the presence of a constantly rich mixture indicating that the presetting of $F_\lambda$ corresponds to an excessive fuel amount. A combination of the oxygen sensor output signal could be, for example, to omit individual response actions in the diagram of FIG. 2(*b*). This would mean that the mean Lambda value $\bar{\lambda}$ would tend more towards $\bar{\lambda}=1+\epsilon$ and $\bar{\lambda}=1-\epsilon$ after having temporarily resided at a low (lean mixture) output voltage and a high (rich mixture) output voltage, respectively.

If perturbation $\Delta F_{\pm}$ superposed on characteristic values $F_{\lambda}$ is considered as being a kind of test series for determining the instantaneous Lambda value, the output signal of the oxygen sensor would represent the test result. On account of the binary character of the oxygen sensor output signal, only one answer is possible to the question of whether or not the test result is in conformity with the algebraic sign of the perturbation $\Delta F_{\pm}$.

For example, if a rich air-fuel mixture is presented to the internal combustion engine by perturbation $\Delta F_{\pm}$, the oxygen sensor may react with either a high or a low output level. In the normal case, a high level (indicating a rich mixture) would have to be expected, and the test result could be characterized as "normal". There would be no reason to modify or adapt factor $F_{\lambda}$. If the sensor showed a low output level (indicating a lean mixture) with perturbation $\Delta F_{+}$ being applied, this test result would be characterized as "catastrophic". In this case, it would be necessary to modify factor $F_{\lambda}$ by a value $+\Delta_2$ to increase the injected fuel quantity. The same applies by analogy to the other possible cases, resulting in the following adaptation table for factors $F_{\lambda}$:

| Perturbation | Sensor Signal | Adaptation of Characteristic Values | |
|---|---|---|---|
| $\Delta F_{+}$ | rich (H) | $-\Delta_1$ | where: $\lvert\Delta_1\rvert = 0$; or, |
| $\Delta F_{+}$ | lean (L) | $+\Delta_2$ | |
| $\Delta F_{-}$ | rich (H) | $-\Delta_2$ | |
| $\Delta F_{-}$ | lean (L) | $+\Delta_1$ | $\lvert\Delta_1\rvert << \lvert\Delta_2\rvert$ |

Accordingly, each individual perturbation $\Delta F_{\pm}$ represents a test, with the test result (that is, the value H/L of the output voltage of the oxygen sensor) serving to adapt the relevant characteristic value $F_{\lambda}$ to the value $\lambda=1$, the characteristic value $F_{\lambda}$ at the instant determining the fuel metering in dependence on at least one operating parameter of the internal combustion engine.

It is to be emphasized in this connection that the room for the special choice of values $\Delta F_{\pm}$ and $\Delta_{\frac{1}{2}}$ is very large. Thus, for example, $\Delta F_{+}$ may be unequal to $\Delta F_{-}$, and $\Delta_{\frac{1}{2}}$ may be varied in dependence on the algebraic sign of perturbation $\Delta F_{\pm}$. Further, it may be useful to change the amplitude(s) of perturbations $\Delta F_{\pm}$ in dependence on whether the test result is "normal" or "catastrophic". If the "catastrophic" results are very few (indicating that $\bar{\lambda}$ lies very close to $\bar{\lambda}=1$), the amplitude of the perturbation (the modulation swing) can be reduced to a lower limit which can be fixedly predetermined externally, for example. The same applies to the opposite case.

The modulation table described with reference to FIG. 2(*a*) was only cited by way of example; there are no limits to the variation possibilities of the modulation sequence. For example, it may prove advantageous in particular for engines having an even number of cylinders to reverse the sequence of perturbation signals according to a period of time selectable in dependence on operating parameters, for example, so that it is not always the same cylinder which receives a richer or leaner mixture because of the perturbation.

Under certain preconditions, a free assembly of the perturbation pulse pattern in dependence upon the operational conditions of the engine can contribute to a considerable improvement in the running characteristics of the engine.

In a case where a sequential injection system is used, it is also possible to adapt the fuel metering to each specific cylinder. For this purpose, a checking algorithm is used which operates in dependence on the frequency of the test result "catastrophic", or at defined time intervals, or only at service intervals. This checking algorithm permits the determination of whether individual cylinders deviate significantly from the average behavior of the other cylinders. In case of larger deviations, this information may also be used for purposes of engine diagnosis. An embodiment covering the widest possible range would involve the use of sets of characteristic curves corrected for each specific cylinder. However, in practice and under normal conditions, it would also suffice to have for each specific cylinder a multiplicative or additive valve correcting factor for the injected fuel quantity which corrects the amount of fuel injected by the specific valve in a positive or negative direction. In practice, if an adaptation to each individual cylinder were chosen, the storage requirements would increase maximally by the factor n, which is determined by the number of cylinders.

In particular at higher engine speeds or longer perturbation signal sequences (as will be explained below), a corrective adaptation for each individual cylinder would also be feasible by ensuring that during the test cycle the air-fuel mixture of (n−1) cylinders of an n-cylinder internal combustion engine is preferably on the rich (or lean) side and that only the nth cylinder is modulated. Because of the state of transition of the Lambda signal of this single cylinder, this cylinder is calibrated individually according to the general specification already indicated, and the relevant characteristic value of the injected fuel quantity is compared with the individually determined mean value of the other cylinders. This advantageously permits suppressing any freak values that might occur. If necessary, a valve correcting value is then stored for this particular cylinder.

The foregoing was based on the understanding that in internal combustion engines with fuel injection each injection valve is actuated separately. In this case, for a four- (six-) cylinder internal combustion engine, the following equation results for the maximum frequency $f_{max}$ of the torque variations or the response sequence of the oxygen sensor: $f_{max}=n(3/2n)$.

It is to be understood that such a modulation method is also suitable for use in injection valves connected in parallel and actuated jointly. Since there is one injection for each crankshaft revolution, perturbation $\Delta F_{\pm}$ occurring in a sequence of $\Delta F_{+}$, $\Delta F_{-}$, $\Delta F_{+}$, (where: $\lvert\Delta F_{+}\rvert=\lvert\Delta F_{-}\rvert$), produces no variation of the air-fuel mixture at all since each cylinder receives one rich and one lean injection per combustion process. In this arrangement, it will be suitable to apply the sequence $\Delta F_{+}$, $\Delta F_{+}$, $\Delta F_{-}$, $\Delta F_{-}$, . . . , for example, in which case, however, the response frequency of the oxygen sensor will be reduced to the value $f_{max}/2$. Such a perturbation sequence would cause a Lambda modulation of $\Delta\lambda=+\epsilon, 0, -\epsilon, 0, +\epsilon, \ldots$. In this event, the modulation $\Delta\lambda=0$ and this would result in a random signal of the binary-operating oxygen sensor which would have to be suitably suppressed when adapting the characteristic values $F_{\lambda}$.

The $\Delta_{\frac{1}{2}}$ corrections to the characteristic values $F_{\lambda}$ are responsible for a limit frequency which, however, assumes very low-frequency values because only slow drifts as they occur in air pressure, elevation above sea level, fuel temperature or age have to be compensated for.

Now that the general idea of the invention has been explained, a possible implementation will be discussed in the following.

In the practical realization of the invention, the problem is essentially to correlate the algebraic sign (plus the amplitude, where applicable) of the perturbation $\Delta F_{\pm}$ with the relevant reaction of the oxygen sensor to the perturbation, because the output signal of the oxygen sensor is not available until after the above-mentioned air transit time T and response time $\tau$ after application of the perturbation. Transit time T depends to a large extent on particularly the engine speed and also on the pressure of inducted air or rate of air flow of the internal combustion engine. As mentioned previously, response time $\tau$ of the oxygen sensor depends on the sensor temperature or on its internal resistance which is clearly a function of temperature. The total time $T+\tau$ may be determined in one of the following ways.

The transit time can be determined from engine speed n and, where applicable, from the pressure p of inducted air or the inducted air mass $Q_L$. For the determination of $\tau$ it would be suitable to measure the load because the exhaust gas temperature and consequently also the oxygen sensor temperature or the internal resistance thereof are essentially dependent on the load. On the other hand, by heating the sensor for temperature control purposes, it would also be possible to maintain the response time $\tau$ at a value that is almost independent of the operating parameters of the internal combustion engine, that is, it would be possible to maintain the response time $\tau$ at a nearly constant value. Likewise, the sensor internal resistance could be measured directly as it is already done in known arrangements for sensing the operating condition of the oxygen sensor.

A preferred embodiment for experimentally determining the total time $T+\tau$ lies in the possibility to determine $T+\tau$ directly during operation of the internal combustion engine. A coded perturbation sequence is used in lieu of the regular perturbation sequence $\Delta F_+$, $\Delta F_-$, $\Delta F_+$, . . . , and the unknown total time $T+\tau$ is determined via a cross-correlation analysis of signals $\Delta F_{\pm}(t)$ and the deviation $\Delta U_{\lambda}(t)$ of the output voltage of the oxygen sensor from its mean value. The cross-correlation function $R(t')=E\{\Delta F_{\pm}(t)\cdot\Delta U_{\lambda}(t+t')\}$, where E is the expected value, assumes a maximum for $t'=T+\tau$, so that a correlator known per se (see R. C. Dixon, "Spread Spectrum Systems", Chapter 3, Wiley Interscience, New York, 1976) permits determination of total time $T+\tau$ experimentally.

Figure 3:
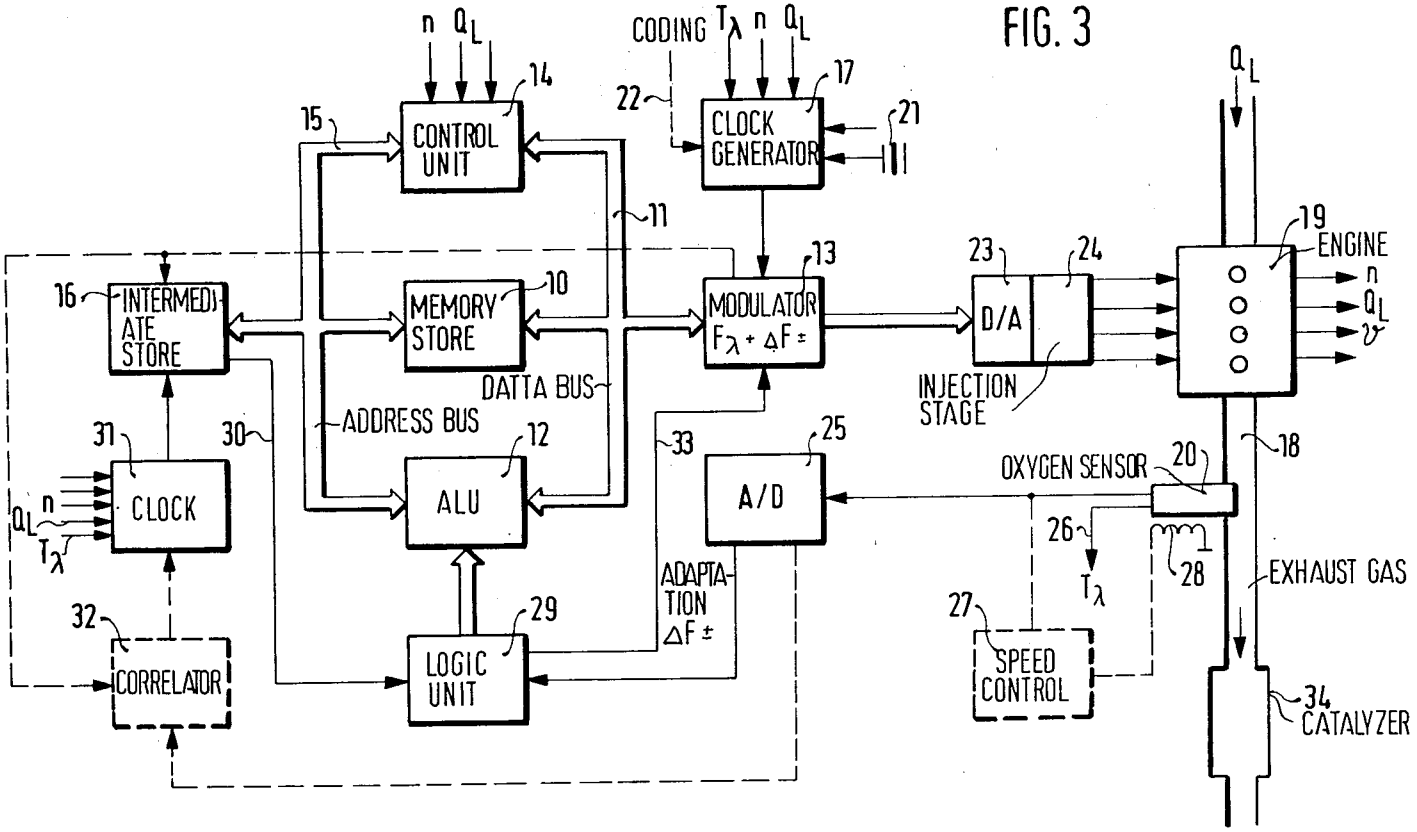

An embodiment of the method of the invention will be explained in more detail in the following with reference to the block diagram of FIG. 3.

A memory store identified by reference numberal 10 serves to store the characteristic values $F_{\lambda}$ (n, $Q_L$). A data bus 11 connects memory store 10 to an ALU (arithmetic and logic unit) identified by reference numeral 12, a modulator 13 and a control unit 14, with the various parameters of an internal combustion engine 19 being directed to control unit 14. Such parameters can include engine speed n and inducted air mass $Q_L$ and are indicated by arrows. Further, an address bus 15 connects memory store 10 to control unit 14, ALU 12 and an intermediate store 16. Modulator 13 receives clock signals from a clock generator 17, with the clock frequency being variable in dependence on, for example: the temperature $T_{\lambda}$ of an oxygen sensor 20 located in an exhaust pipe 18 of internal combustion engine 19, the rotational speed n of the internal combustion engine, the inducted air mass $Q_L$, or the load. However, it is also possible to provide a clock frequency which is independent of engine speed using, for example, a quartz oscillator 21.

A further input 22 shown in broken lines also permits coding of the perturbation sequence for experimental determination of delay time $T+\tau$ (as indicated further above). A digital-to-analog converter 23 converts the digital output signals of modulator 13 into analog signals to be applied to injection final stages 24 which activate the injection valves (not shown) of internal combustion engine 19 for fuel metering.

The oxygen sensor output signal, which is dependent on the oxygen content of the exhaust gases of internal combustion engine 19, is applied to an analog-to-digital converter 25 which, on account of the quasi-binary sensor signal, is preferably a one-bit converter (if the sensor signal is evaluated as a ternary signal, a two-bit converter is necessary). The temperature of oxygen sensor 20 is either issued by a temperature sensor via output line 26 or, for example, it is actively regulated to a constant temperature by means of a temperature regulator 27 known per se using a heater 28. Further, a catalyst 34 is provided in exhaust pipe 18 of internal combustion engine 19 to reduce pollutant emissions.

The output of analog-to-digital converter 25 is connected to a logic unit 29 receiving further input signals from intermediate store 16 via a line 30. On its output side, logic unit 29 supplies single- or multi-valency bit information which is fed to ALU 12.

Intermediate store 16 which, for example, may be a shift register, receives, in addition to input quantities $F_{\lambda}$ (n, $Q_L$), a modulation bit as a further input information. This modulation bit indicates whether modulator 13 is providing a richer or a leaner mixture. The storage time of the intermediate store can be influenced by a clock 31 in dependence on various operating parameters of the internal combustion engine 19 indicated by arrows such as the oxygen sensor temperature T, engine speed n, inducted air mass $Q_L$ or other quantities.

Finally, a correlator 32 is provided which receives its input signals from analog-to-digital converter 25 and modulator 13 and influences clock 31 with its output quantity. In addition, a line 33 connects logic unit 29 to modulator 13.

The mode of operation of the arrangement will be described in the following.

Starting from a specific operating condition of the internal combustion engine, a suitable value is selected in memory store 10 wherein the set of characteristic values are stored. Modulator 13 superposes a positive or negative perturbation on this suitable characteristic value in dependence on the clock frequency of clock generator 17; the value is then converted to an analog value in the digital-to-analog converter and applied to the relevant injection stage 24 to open the injection valve for a suitable period of time. At the same time, the address of the selected characteristic value and the algebraic sign of the perturbation produced in modulator 13 are stored in intermediate store 16.

Clock 31 determines, in dependence on operating parameters of the internal combustion engine, the storage time of these two information items. It is also possible to control the clock unit by applying the output of correlator 32 thereto, the correlator 32 being used for the experimental determination of the necessary storage time. In any case, provisions must be made to ensure that the storage time in the intermediate store corresponds exactly to the delay time ($T+\tau$) in the response behavior of oxygen sensor 20. If this is the case, the revelant tests (algebraic sign of the perturbation) can be correlated with the associated test results (output signal of the oxygen sensor) in logic unit 29. In ALU 12, the relevant characteristic value, the address of which was likewise stored in the intermediate store during the delay time, is adapted to the new conditions in accordance with the test result "normal" or "catastrophic" (see table above).

Control unit 14 provides a correct timing of the events. For example, if the characteristic value was changed by the ALU, the logic unit has to be disabled during delay time $T+\tau$ to enable the oxygen sensor to detect the effect of the latest change. This means that in the stationary case, the characteristic value can only be changed in time units of $T+\tau$, maximum.

In a simplified embodiment of the invention, a very accurate determination of the delay time $T+\tau$ is dispensed with. Instead of individual positive or negative perturbation signals, longer perturbation signal sequences are evaluated. In this case, it would only have to be checked whether a new characteristic value was accessed during this perturbation signal sequence. If this is indeed the case, the simplified procedure is to assume that this characteristic value cannot be of major significance for the operating behavior of the internal combustion engine since it was accessed only a very short time. However, if the characteristic value continues to be unchanged during the entire sequence, the procedure is again, as before, dictated by the signal shape of the oxygen sensor output signal (see FIG. 2). In addition to the measures for changing the characteristic value as indicated in the table, this simplified procedure would also permit the length of the perturbation sequence to be shortened in order to again carry out a fast corrective intervention.

If it is desired to reduce the amount of computing still further, it may be useful to dispense with the adaptation of each individual characteristic value $F_\lambda$ and to adapt instead one single correction factor or several correction factors which are responsible, for example, for different zones in the characteristic range. This simplified embodiment would still permit the high modulation frequency to be maintained.

The embodiment was explained with reference to a block diagram including various individual components. It is to be understood that those in the art will easily be in a position to implement the method of the invention by means of a suitably programmed microcomputer.

It is understood that the foregoing description is that of the preferred embodiments of the invention and that various changes and modifications may be made thereto without departing from the spirit and scope of the invention as defined in the appended claims.

What is claimed is:

1. Method for forming the air-fuel mixture for an internal combustion engine having a plurality of cylinders sequentially ejecting pulses of exhaust gas, the engine including an oxygen sensor subjected to said pulses of exhaust gas of the engine and being sensitive to the oxygen content of the extent gas to provide an output signal that is changeable from a high condition to a low condition; a signal processing unit for processing the output signals of the oxygen sensor; and, a storage unit for storing a characteristic field having characteristic field values for determining the quantity of fuel to be metered, the characteristic field being dependent upon at least one operating parameter of the internal combustion engine, the method comprising the steps of:

superimposing perturbations upon said characteristic field values ($F_\lambda$) that vary with time;

evaluating the output signals ($U_\lambda$) of the oxygen sensor as to their change with respect to the pertubation quantity;

correcting said characteristic field values to obtain an optimum air-fuel mixture; and, causing said output signal to change between said conditions after the smallest possible time interval determined by the time which passes until the next one of said sequential pulses reaches said oxygen sensor.

2. The method of claim 1, wherein said perturbations are bipolar and continuously change with time, and the method includes the further steps of: superimposing said perturbations upon said characteristic values according to a predetermined pulse pattern, the individual pulses corresponding to respective ones of said individual cylinders; and, analyzing the deviations of the pulse pattern resulting on the oxygen sensor from the expected pulse pattern which has a causal functional relationship with the perturbation pulse pattern.

3. The method of claim 2, wherein the predetermined pulse pattern is freely assembled in dependence upon the operational condition of the engine.

4. The method of claim 2, wherein said predetermined pulse pattern of said bipolar perturbations is continuously changed with time so as to cause a cylinder perturbated in the rich direction to cyclically alternate with cylinders perturbated in the lean direction after a predeterminable time.

5. The method of claim 4, wherein the predetermined pulse pattern is changed after said predeterminable time, and wherein said predeterminable time is changeable in dependence upon the operational condition of the engine.

6. The method of claim 1, comprising: adding or subtracting a perturbation quantity ($\Delta F_\pm$) to or from said characteristic field values to realize said perturbation of said characteristic field values ($F_\lambda$).

7. The method of claim 6, comprising the step of superposing said perturbation quantity ($\Delta F_\pm$) on just the characteristic field value ($F_\lambda$) selected in dependence upon at least one of the operating parameters of the internal combustion engine.

8. The method of claim 7, the time variation of said perturbation quantity ($\Delta F_\pm$) occurring in dependence upon at least one operating parameter of the internal combustion engine.

9. The method of claim 7, the time variation of said perturbation quantity ($\Delta F_\pm$) occurring with constant frequency.

10. The method of claim 9, comprising the step of comparing the output signal ($U_\lambda$) of the oxygen sensor with perturbation quantity while taking account of the time delay ($T+\tau$) between said output signal and said perturbation quantity.

11. The method of claim 10, comprising the step of cancelling said time delay between the output signals ($U_\lambda$) of the oxygen sensor and the perturbation by means of a storage of the perturbation quantity ($\Delta F_\pm$) in an intermediate storage unit.

12. The method of claim 11, the storage time of said intermediate storage unit being adjustable in dependence upon the operating parameters of the internal combustion engine.

13. The method of claim 11, comprising the step of realizing the storage time of said intermediate storage unit in dependence upon the result of cross-correlation analysis of the perturbation quantity ($\Delta F_{\pm}$) and the output signal ($U_{\lambda}$) of said oxygen sensor.

14. The method of claim 13, comprising the step of changing the amplitude of the perturbation quantity ($\Delta F_{\pm}$) in dependence upon the result of said comparison of the perturbation quantity with the output signal of the oxygen sensor output quantity ($U_{\lambda}$).

15. The method of claim 14, comprising the step of correcting said characteristic field values to a value of the air-fuel ratio for which the toxic materials contained in the exhaust gas are reduced to a minimal value by means of a catalytic after-treatment or the like.

16. The method of claim 15, said characteristic field values being corrected to an air-fuel ratio in the neighborhood of $\lambda=1$.

17. The method of claim 16, comprising the step of depositing said characteristic field values in the storage unit for said set of characteristic curves in dependence upon the rotational speed (n) of the engine and at least one of: the quantity of air inducted by the engine and the pressure ($P_L$) in the air intake tube of the engine.

18. The method of claim 17, wherein the engine has a plurality of separately controlled individual injection valves, the method comprising the step of superposing a perturbation ($\Delta F_{\pm}$) on the characteristic field value ($F_{\lambda}$) determining the quantity of fuel for at most once per metering of fuel for each individual cylinder.

19. The method of claim 17, comprising the step of reducing the modulation frequency of the characteristic field values ($F_{\lambda}$) determining the metering of fuel for the case wherein said plurality of injection valves are controlled in common as compared to the case wherein said injection valves are controlled separately.

20. The method of claim 18, comprising the step of correcting the characteristic field values specifically for each cylinder and storing the same.

21. The method of claim 18, comprising the step of determining the characteristic field values for one cylinder and comparing the latter values with the mean value from the characteristic field values of other cylinders and storing cylinder correction values for said one cylinder as required.

22. The method of claim 21, comprising the step of carrying out the individual cylinder adaptation of the characteristic field values ($F_{\lambda}$) in definite time intervals.

* * * * *